US005943302A

United States Patent [19]

Fanshaw

[11] Patent Number: 5,943,302

[45] Date of Patent: Aug. 24, 1999

[54] MODULAR WRISTWATCH ASSEMBLY AND CASE ASSEMBLY FOR SAME

[75] Inventor: Bradley J. Fanshaw, Santa Ana, Calif.

[73] Assignee: Bonneville Watches, Anaheim, Calif.

[21] Appl. No.: 08/748,280

[22] Filed: Nov. 13, 1996

[51] Int. Cl.[6] ..... G04B 37/00; G04B 39/00

[52] U.S. Cl. ..... 368/276; 368/281; 368/294; 368/309

[58] Field of Search ..... 368/220, 223, 368/228, 276, 285, 294–296, 299, 300, 309

[56] References Cited

U.S. PATENT DOCUMENTS

| | | | |
|---|---|---|---|
| 3,910,031 | 10/1975 | Keida | 368/281 |
| 4,397,567 | 8/1983 | Carl | 368/309 |
| 4,459,032 | 7/1984 | Musy | 368/77 |
| 4,522,508 | 6/1985 | Meister | 368/276 |
| 4,558,955 | 12/1985 | Herchenbach | 368/282 |
| 4,627,738 | 12/1986 | Kao | 368/281 |
| 4,696,577 | 9/1987 | Muller et al. | 368/276 |
| 4,967,402 | 10/1990 | Claude | 368/280 |
| 5,033,035 | 7/1991 | Affolter | 368/294 |
| 5,243,578 | 9/1993 | Mathez | 368/88 |

OTHER PUBLICATIONS

International Watch, 1995–1996 No. 28, USA Edition; Geuril: A New Generation of Time Woven From History by Roberta Naas (pp. 52–53).

Hammacher Schlemmer Holliday 1996 Catalog; Wardrobe Matching Interchangable Watch (p. 4).

*Primary Examiner*—Vit Miska

*Attorney, Agent, or Firm*—Howard R. Lambert

[57] ABSTRACT

A modular wristwatch assembly comprises a bezel having a transparent watch crystal mounted therein, first and second pairs of watch band lugs joined to opposite exterior side edge regions of the bezel, a rigid watch back member, and a rigid, annular watch movement retaining member disposed between the bezel and the back member. Included in the assembly are a watch movement, having a watch face and hands for indicating the time, installed in the watch movement retaining member and having operating controls extending outwardly therethrough. There is further included a decorative ring installed between an under surface of the bezel and an upper surface of the watch face, the ring being around peripheral edge regions of the face so as not to interfere with the time indicating means and being visible through said watch crystal. Screws are used for detachablably attach the bezel and the watch back member together with the watch movement retaining member and watch movement held therebetween. A corresponding modular wristwatch case is provided which does not have the watch movement installed.

6 Claims, 3 Drawing Sheets

MODULAR WRISTWATCH ASSEMBLY AND CASE ASSEMBLY FOR SAME

BACKGROUND OF THE INVENTION

1. Field of the Invention

The present invention relates generally to the field of timepieces and, more particularly, to the field of watches and, still more particularly, to the field of wristwatches and wristwatch cases.

2. Background Discussion

In order to better understand and appreciate the present invention relating to modern wristwatches and cases therefor, a brief horological perspective is considered desirable and is presented hereinbelow.

Devices for displaying the current time and measuring the passage of time have been known for hundreds if not thousands of years. Before mechanical clocks were invented, such time keeping devices as sun dials, hour glasses and water clocks had been in use for centuries. Early mechanical clocks were costly and village clock towers-often church steeples—which had clock faces that could bee seen from long distances and which tolled at least the hours were common and can still be seen in many towns and cities throughout the world. Perhaps the most famous clock tower in the world is the tower housing Big Ben in London, England.

As rural farming villages gave way to towns and cities, and as commerce became more important and widespread, and the income level increased, more and more families acquired their own timepieces. Thus, for example, wall and mantle clocks became a fixture in many well to do homes.

Major advances in exploration and particularly ocean navigation in the 1400's can be attributed to the invention of the chronograph which enabled sailing distances to be determined with accuracy. This enabled accurate mapping of the oceans, islands and continents.

A growing need soon arose for portable time pieces that could be carried by individuals. Perhaps the earliest type of portable timepiece was a pocket sundial, modern replicas of which are available as curiosities. Such portable sun dials had the distinct disadvantage that the sun must be available. Hence, pocket sundials could not provide time indoors or outdoors when the sun was not shining. Moreover, as clocks became common, more precise time determination was demanded of portable timepieces than could be provided by pocket sundials.

In any event, mechanical, wind-up pocket watches first came on the scene in about the 1700's, and are still in somewhat common usage, and fancy pocket watches on the ends of heavy gold chains became a symbol of status and importance. Pocket watches were, however, found to be relatively inconvenient to use-especially as the pace of life quickened and people increasingly began to live their lives by the clock rather than by sunrise and sunset.

Wristwatches came into popular use early in the 20th century and by the end of World War II most adults in industrialized counties had at least one wristwatch. By that time, wristwatches manufactured by such U.S. companies as Benrus, Bulova, Elgin, Hamilton, Longines and Whitanaur were well known. Wristwatches were then most commonly of the mechanical windup type, inexpensive versions of which later become popularized by the Timex watch company's jingle: "It takes a licking and keeps on ticking." More expensive, self-winding or "automatic" mechanical watches also became generally available after WW II.

As a commercial use of space-age technology and its microminiaturization technology, electric or electronic (i.e., battery-powered) analog watches became available to a limited extent in the United States in about the late 1960's. A notable example of an early electronic wristwatch is Bulova's high-end "ACCUTRON" battery-powered watch which used a transistorized circuit to drive a miniature tuning fork as a timing standard, and which used a miniature motor for operating the analog time display which consisted of hour, minute and second hands.

In the early 1970's, battery-powered wristwatches with digital time displays and quartz timing devices were introduced—initially principally as a "hi-tech" novelty and subsequently (and still currently) as an inexpensive alternative to mechanical watches. Digital watches employing power-hungry and often difficult to read red LED (light emitting diode) time displays, which had to be activated to read the time, were first on the market, but were soon displaced by constant-display LCD (liquid crystal displays) wristwatches. However, digital quartz wristwatches soon lost most of their popularity-except for low-end wristwatches—because LCD displays are difficult to read, especially in bright sunlight which overpowers the LCD display, and must be back lit to be read in low light or in the dark.

By the late 1980's, analog quartz wristwatches had become more or less the standard for most individuals; although, some multi-function watches have continued to use LCD displays, for example, for a second time zone display or for stop-watch purposes. Most analog electric watches are now manufactured by (or for) Japanese companies by such companies as Seiko, Casio and Citizen which essentially dominate the wristwatch market.

Nevertheless, there has remained through evolving wristwatch history what might be termed an important niche market for precision mechanical wristwatches, now primarily of the self-winding (i.e., automatic) type, as exemplified by such well-known Swiss-made watches as ROLEX and OMEGA. Many of such watches are very expensive for the average person and are often made with solid gold cases, with some models using gem stones, such as diamonds, in lieu of hour numbers on the watch face and/or as watch case decorations. To many, such wristwatches as ROLEX have become a symbol of status and are often worn more for display than for timekeeping purposes.

It is to this high-end, precision mechanical wristwatch market that the present modular wristwatch assembly invention is principally (but not necessarily) directed, since it enables the cost-efficient production of limited quantities of expensive wristwatches.

The present invention also enables, as described below, watchmakers to provide various models of different appearance without incurring the high tooling costs heretofore associated with introducing new watch models. It also enables the rapid introduction of new models and even permits customers to customize their own wristwatch.

SUMMARY OF THE INVENTION

In accordance with the present invention, there is provided a modular wristwatch assembly which comprises a case bezel having a transparent watch crystal mounted therein, and having first and second pairs of watch band lugs joined to opposite exterior side edge regions of the bezel. Included are a rigid watch back member and a rigid, annular watch movement retaining member disposed between the bezel and the back member.

Further included in the modular watch assembly is a watch movement, which may be either mechanical or electronic, having a watch face or dial and time indicating means. The watch movement is installed in the watch movement retaining member and has operating controls extending outwardly through the retaining member wall for manual operation by a wearer.

Further included are means for detachablably attaching the bezel and watch back member together with the watch movement retaining member, with the installed watch movement, retained or sandwiched therebetween. The watch movement may be mechanical or electronic (for example, quartz, and may provide time indicating means which are analog or digital, or a combination thereof.

There is included a wrist band having first and second ends which are detachably attached to respective first and second pairs of the watch band lugs on the bezel.

The means for detachably attaching the bezel and watch back member together, with the movement and the movement retaining member retained therebetween, preferably include a plurality of attachment ears sidewardly projecting from edges of the watch back member. Such ears are formed having apertures aligned with the watch band attachment lugs. Screws are installed through the apertures in the ears and extend into threaded recesses in lower regions of the lugs.

In accordance with a preferred embodiment of the invention, a decorative ring, which is preferably replaceable so as to provide different watch face appearances, is installed between an under surface of the bezel and an upper surface of the watch face. The ring is preferably detachably attached to the watch face, and is sized to fit around peripheral edge regions of the face so as not to interfere with the time indicating means and to be visible through the watch crystal in the bezel.

For some wristwatch assemblies, a transparent crystal is installed in the watch back member so that an underside of the watch movement installed in the watch movement receiving member is visible through the watch back member.

There is correspondingly provided a modular wristwatch case which comprises a case bezel having a transparent watch crystal mounted therein and having first and second pairs of watch band lugs joined to opposite exterior side edge regions of the bezel. Included is a rigid watch back member and a rigid, annular watch movement retaining member sized for being mounted between the bezel and t he back member.

Further included in the case are means for detachablably attaching the bezel and watch back member together with the watch movement retaining member held or sandwiched therebetween. Such means include a plurality of attachment ears sidewardly projecting from edges of the watch back member. Such ears are formed having apertures aligned with the watch band attachment lugs. Screws are provided for installation through the apertures in the ears and into threaded recesses in lower regions of the lugs.

A decorative ring, which is preferably replaceable with different configurations, is provided for installation between an under surface of the bezel and an upper surface of the watch face. The ring is configured for being detachably attached to said watch face, and is sized to fit around peripheral edge regions of a face of a watch movement installed in the movement retaining member so as not to interfere with time indicating means of the movement and so as to be visible through the watch crystal in the bezel.

For some wristwatch cases, a transparent crystal is installed in the watch back member so that an underside of a watch movement installed in the watch movement receiving member is visible through the watch back member.

By interchanging different bezels (for example, bezels of the same configuration but made from a variety of different materials and finishes such as gold, polished stainless steel or brushed stainless steel), watch movement retaining members (also of the same configuration but made from different material and/or finishes), watch back members and decorative rings (of the same or different configurations and materials and finishes), the appearance of the modular wristwatch case assembly can be easily and substantially changed. By interchanging watch movements and movement faces, the wristwatch assembly can be further changed and can be customized according to a customer's preference.

BRIEF DESCRIPTION OF THE DRAWINGS

The present invention can be more readily understood by a consideration of the following detailed description when taken in conjunction with the accompanying drawings, in which.

In the various FIGS., the same elements and features are given the same reference numbers.

DESCRIPTION OF THE PREFERRED EMBODIMENT

Figure 1:
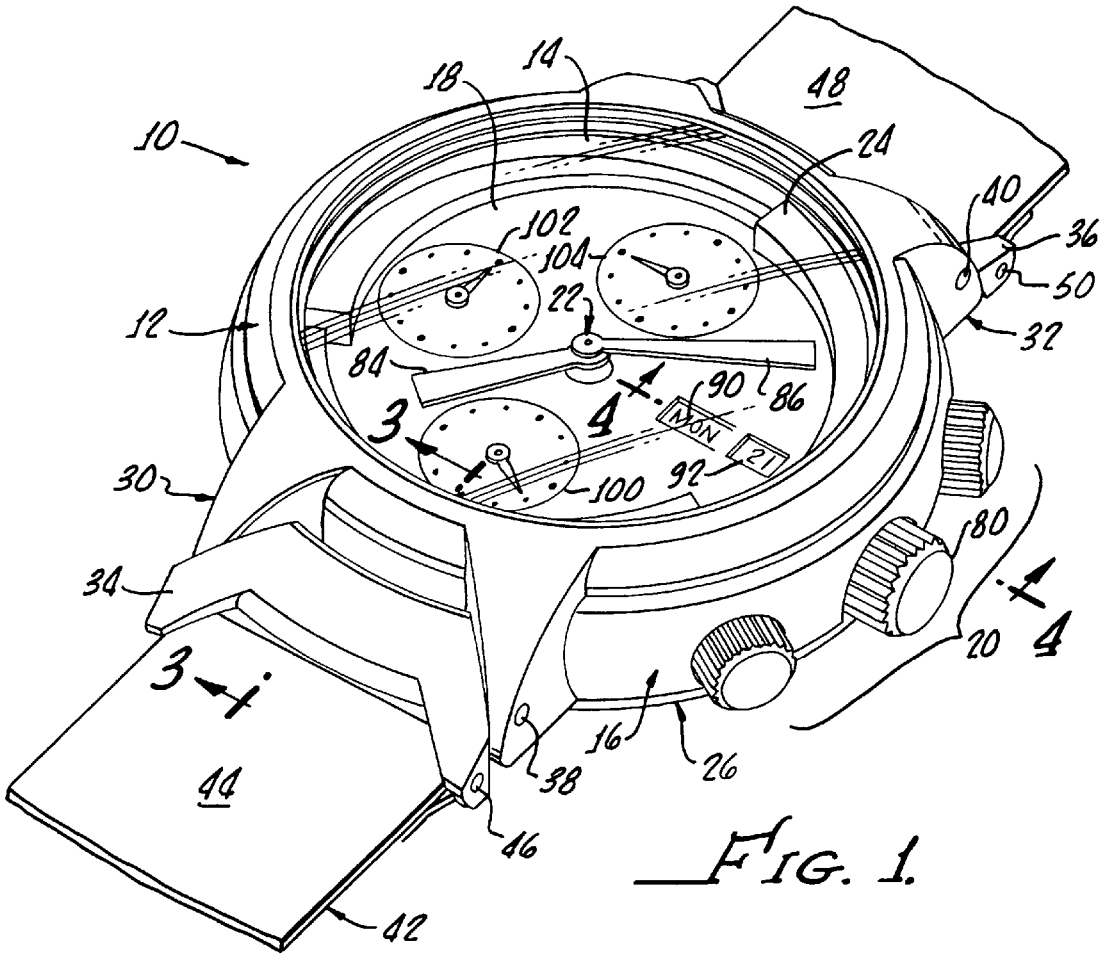
FIG. 1 is an enlarged perspective drawing of the modular watch of the present invention, showing its external features and showing its modular construction.

There is shown in FIG. 1, an exemplary modular wristwatch assembly or system 10 in accordance with a preferred embodiment of the present invention. By way of illustration, with no limitation thereby intended or implied, modular wristwatch assembly 10 is depicted as being of an analog, chronometer type with day and date display and stopwatch function. It will be appreciated that the present invention applies as well to a single function analog wristwatch, a single or multi-functional digital wristwatch or a combination analog and digital wristwatch.

As more particularly described below, further comprising modular wristwatch assembly 10 is a bezel 12 having installed therein a watch crystal 14, and a centrally located, annular watch movement holding or receiving member 16. Included is a watch face or dial 18 of a watch movement (not shown in FIG. 1) which is retained in the movement receiving member 16. Watch movement control means 20 extend through a side wall of movement retaining member 16. Associated with watch face 18 are time display means 22. A removable and replaceable decorative ring 24 is shown mounted on top of watch face 18 beneath bezel 12 so as to be visible through watch crystal 14. Further included is a lower back plate or member 26.

Respective first and second pairs of wrist band lugs 30 and 32 are joined to opposite side edge regions of bezel 12 to enable the attachment of a conventional metal watch band or bracelet (not shown). By way of illustrative example, first and second wrist strap adapters 34 and 36, respective, are detachably connected to respective wrist band lug pairs 30 and 32 by pins 38 and 40, respectively, to enable the attachment of a narrower wristband 42, for example, a conventional leather wristband which is narrower than a metal watch band.

As further shown in FIG. 1, a first end 44 of watch strap 42 is detachably connected by a pin 46 to first adapter 34 and a second end 48 of watch strap 42 is detachably connected to second adapter 32 by a pin 50.

Although ends of pins 38, 40, 46 and 50 are shown in FIG. 1 for illustrative purposes, it is to be understood that ends of such pins would normally not extend entirely through pairs of lugs 30 and 32 and adapters 36 and 36, but would be hidden, spring types, such as are commonly used to attach wrist bands or straps to wristwatches.

Figure 2:
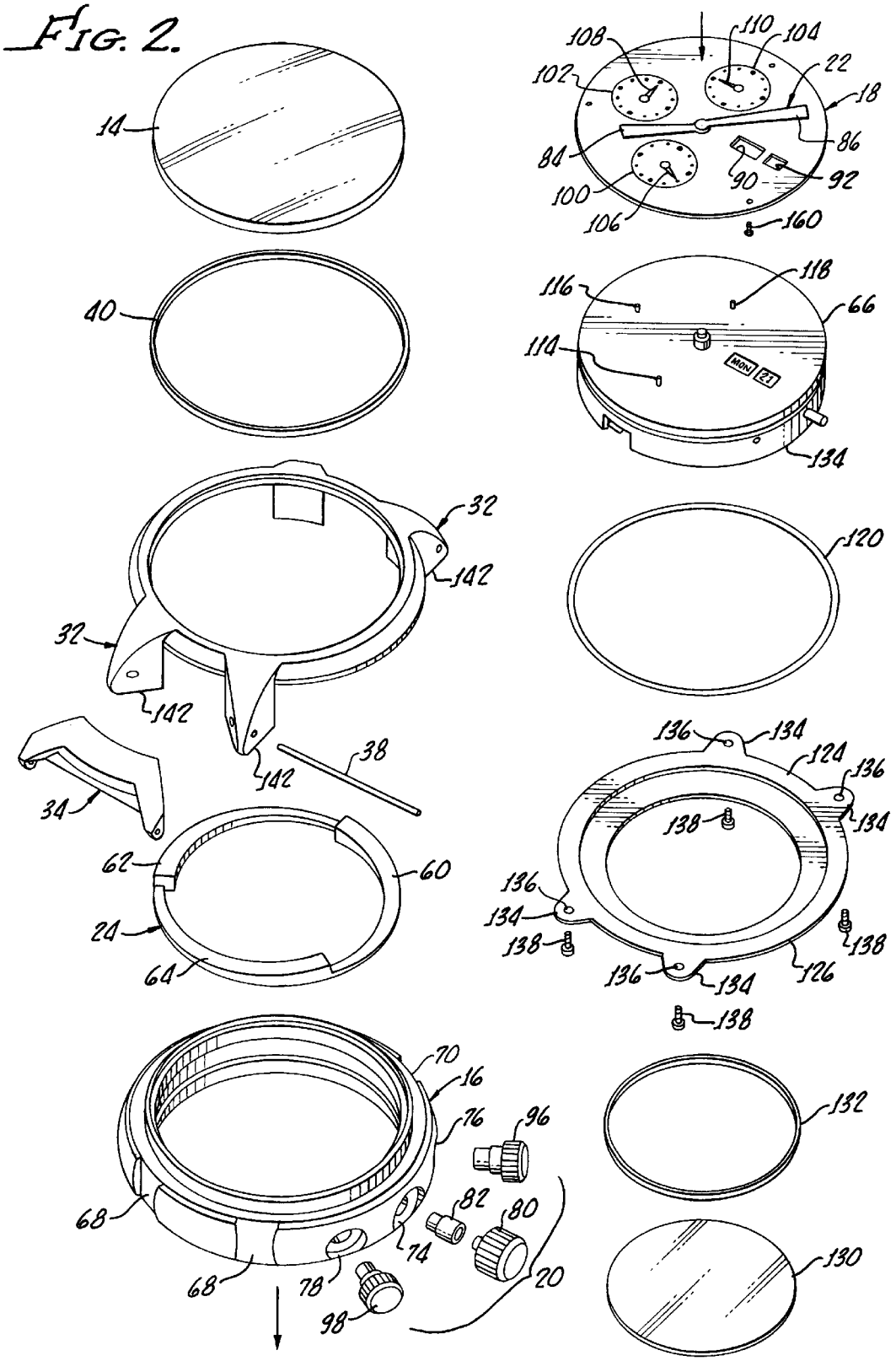
FIG. 2 is an enlarged exploded perspective f the modular watch of FIG. 1 showing all the component parts thereof.

Describing modular wristwatch assembly 10 more particularly, there is shown in FIG. 2, in exploded perspective, all the various component parts of the wristwatch assembly. Shown from top left to bottom left are circular watch crystal 14, which is preferably constructed from a scratch-resistant mineral glass or saphire; a watch crystal retainer ring 40 and bezel 12 having first and second, sidewardly extending pairs of watchband attachment lugs 30 and 32.

It is preferred for strength and appearance that first and second pairs of watch band attachment lugs 30 and 32 are machined in conjunction with the machining of bezel 12 to be integral with the bezel. Alternatively, but less preferably, lug pairs 30 and 32 can be separately formed and be welded to sides of bezel 12 after the bezel is formed.

First wrist strap adapter 34 is shown by way of example in FIG. 2, as is its connection pin 38. It will be appreciated, however, that if modular wristwatch 10 is provided with a metal band or bracelet with curved end attachments which match the curvature of bezel 14, first adapter 34 (as well as second adapter 36, which is not shown in FIG. 2) would ordinarily not be needed and would not be attached to lug pairs 30 and 32. Adapters 34 and 36 could, nonetheless, be supplied with wristwatch 10 as accessories in case a buyer later desires to attach a slender wrist strap, like strap 42, as depicted in FIG. 1. In such case, adapters 34 and 36 could be used to give the appearance that the watch strap "flows" or merges into bezel 14.

Bezel 12 and first and second pairs of lugs 30 and 32 can be constructed of such metals as gold and polished or brushed stainless steel.

Decorative ring 24 is depicted in FIG. 2, by way of illustration, with no limitation being thereby intended or implied, as being configured with first, second and third similar and interconnected ramps 60, 62 and 64, respectively, which widen as the height of the ramps increase. The purpose of ring 24 is to provide a distinctive appearance to modular wristwatch assembly 10 which cam be changes by the installation of rings 24 of different configurations.

Since ring 24 is not a structural part of modular wristwatch 10, it can be constructed, not only of a precious metal or stainless steel (polished or brushed), but of aluminum which can be anodized in different colors or of a plastic material which can be provided in different colors. As described above, ring 24 is installed under bezel and on top of watch face 18 and is sized to circle the periphery of the watch face without interfering with any time display and yet to be visible through watch crystal 14, as shown in FIG. 1.

Watch movement retaining member 16 is formed as an annular ring shaped to retain watch movement 66 and watch face 18. Retaining member 16 is formed having first and second pairs of shallow recesses or notches 68 and 70 for receiving, upon assembly of wristwatch 10, inner regions of respective pairs of wristband lugs 30 and 32 in a closely-fitting relationship so that the lugs appear to also be part of member 16.

Formed through a side of retaining member 16 are apertures 74, 76 and 78 for installation of control means 20. As shown in FIG. 2, control means 20 comprise a central knob 80 with a stem 82 which, for the day/date type of movement 66 depicted, is operatively connected for setting hour and minute hands 84 and 86 (associated with watch face 18) and the day and date functions visible through windows 90 and 92 in the watch face. First and second push buttons 94 and 96 are installed through respective apertures 76 and 78, the first button being operatively connected to movement 66 for starting and stopping stopwatch functions of the movement and second button 98 being operatively connected to the movement for resetting to zero the stopwatch function. It will, of course, be understood that other, more simple or more complex configurations of control means 20 can be provided depending on the functions provided by watch movement 66, with appropriate apertures being formed in movement retaining member 16.

Watch movement retaining member may be constructed, for example, gold and polished or brushed stainless steel. In any particular modular wristwatch assembly 10, movement retaining means 16 and bezel 12 (with) lug pairs 30 and 32) may be constructed of the same, different or contrasting materials, according to the appearance desired by the manufacturer or, in the instance of a customized wristwatch, the buyer.

For the type of movement 66 being described by way of illustration of the present invention, watch face 18 further includes first, second and third small, calibrated dials 100, 102 and 104. Hands 106, 108 and 110 shown associated with respective dials 100, 102 and 104 and connected (upon assembly) to movement 66 by respective drive pins 114, 116 and 118, may, for example, display tenths of seconds, seconds and minutes, according the type of movement 66 involved. As previously mentioned, the day and date provided by watch movement are visible through respective apertures 90 and 92 in face 19.

Watch face 19, regardless of configuration, may be made from any thin, suitable material, such as brass, and may be finished in any desired manner. As an example, there may be provided a black face with white dials 100, 102 and 104 and hour and minute hands 84 and 86 and black hands 106, 108 and 110, or the just mentioned color scheme may be reversed. Other color schemes may, of course, be used to provide a contrast or to coordinate with bezel 14 and/or movement retaining member 16, as may be desired by the watch manufacturer or customer.

Watch movement 66 may be any type, for example, an existing type that is commercially available or is already made by the manufacturer of modular wristwatch assembly 10. As previously mentioned, watch movement 66 may be of a mechanical type, either automatic (self winding) or a wind-up type, or may be a quartz electronic type, or any other type which may be or may become available.

Figure 3:
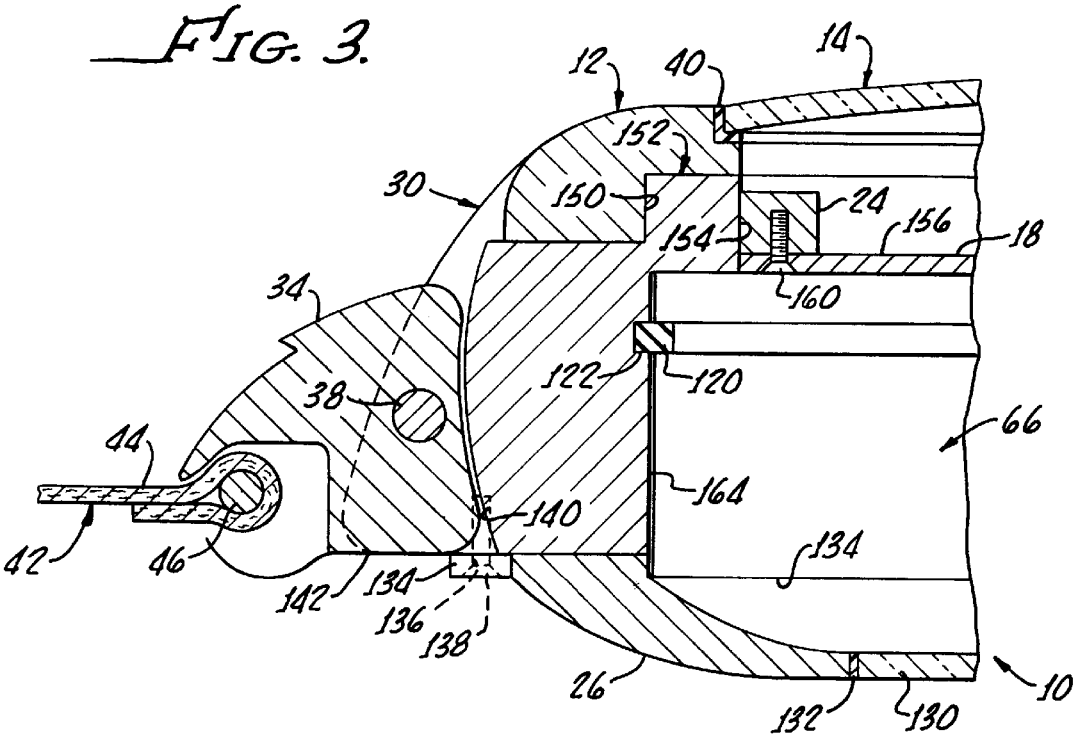
FIG. 3 is an enlarged transverse cross sectional drawing taken along line 3—3 of FIG. 1 showing the manner in which a bezel; a decorative ring; a central, watch movement member and lower back member are interconnected.
Figure 4:
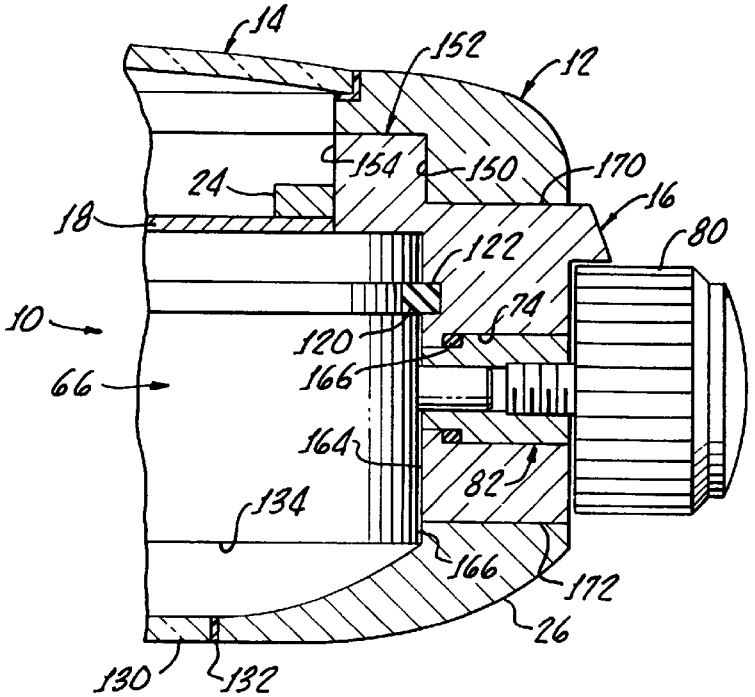
FIG. 4 is an enlarged transverse cross sectional drawing taken along line 4—4 of FIG. 1 showing other internal features of the modular watch of FIG. 1.

A retainer ring 120 is provided for retaining movement 66 in a mating groove or recess 122 formed around the inside of movement retaining member 16 (see FIGS. 3 and 4).

Watch back member 26 comprises a flat peripheral edge region 124 which surrounds a concave, dished region 126. A central aperture 128 may be provided in back member 26 for mounting a case back crystal 130, which is retained in aperture 128 by a crystal retaining ring 132. Crystal 130 enables an under side 134 of watch movement 66 to be seen, as is desirable for some modular wristwatches 10 having mechanical movements. As an alternative, watch back crystal 130 may be replaced by a metal plate the size of the crystal if viewing of movement is not wanted. This enables watch back member to be used either with or without movement viewing. As still another alternative, back member 26 may be formed without central aperture 128 is watch movement viewing is not desired.

Case back member 26 is further formed having a plurality-four-of ears or tabs 134 which project sidewardly outward from peripheral region 124 and in the plane thereof. Ears 134 are located so that one of the ears is under a corresponding one of lugs 30 and 32. A small aperture 136 is formed through each ear 134 for receiving a screw 138 that upon assembly extends through the aperture and into a threaded recess 140 formed upwardly into one of lugs 30 or 32 from a bottom surface 142 thereof (FIG. 3).

Watch back member 26 is constructed of a non-corroding material, preferably, but not necessarily, of stainless steel or gold.

FIGS. 3 and 4 show cross sections of the assembled modular wristwatch 10. Such FIGS. show than an annular stepped region 150 of bezel fits downwardly over an annular shoulder region 152 of watch movement retaining member 16. Decorative ring 24 fits against an inner annular surface 154 of shoulder region 152 and rests against an upper surface 156 of watch face 18. Ring 24 may be detachably attached from an underside to watch face 18 by small screws 160 (FIG. 3).

As previously mentioned, watch movement 66 is retained in member 16 by retainer ring 120 which snaps into annular recess 122 formed around an inner surface 1164 of the member. As shown in both FIGS. 3 and 4, watch movement 66 fits downwardly into an inner corner region 166 of back member 26.

By way of example, an O-ring seal 166 is installed around stem 82 of control 80. If desired seals (not shown) may be installed at an interface 170 between bezel 12 and movement retaining member 16 and at an interface 172 between the movement retaining member and case back member 26.

Figure 5:
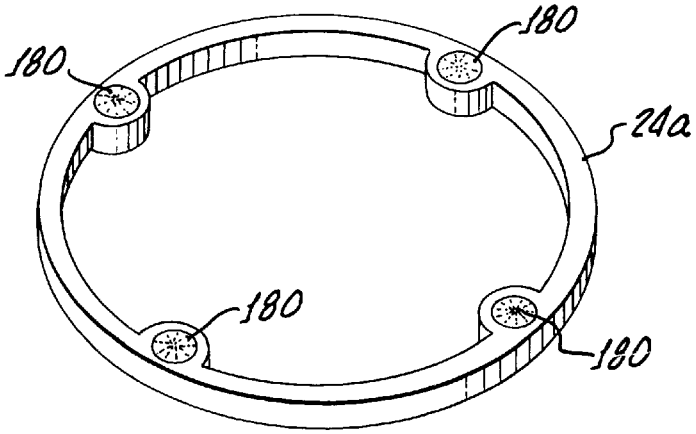
FIG. 5 is an enlarged perspective drawing of an alternative decorative ring.

There is shown in FIG. 5 by way of example, a variation decorative ring **24*a*** having a jewel, such as a diamond or ruby, installed at the 3, 6, 6 and 12 o'clock positions. Other decorative rings of other construction and design can also be provided.

It is to be understood that a modular wristwatch case assembly can be provided which comprises all the above-described components of wristwatch 10 except watch movement 66 and perhaps watch strap 42 and adapters 34 and 36, and with or without apertures 74, 76 and 78 in movement retaining member 16. The modular wristwatch case can thus be supplied by case manufacturers to manufacturers of watch movements 66 for installation of the watch member and addition of a watch band or strap 44.

In this regard, a case manufacturer can supply bezels 12 and movement retaining members of different materials and/or finishes and decorative rings of various designs so that an assembler of modular wristwatch 10 can make various versions of the wristwatch using the standard parts.

Although for purposes of describing the present invention, modular wristwatch 10 has been illustrated and describes as being generally round in plan view, it is to be understood that it is within the scope of the invention that it be made in any shape, such as square, octagonal, oval, elliptical or any other shape in plan view that may be desired and for which a movement 26 can be provided or obtained. Bezel 12 may be faceted or be made with any decorative peripheral or surface shape or pattern; it may be set with jewels or may be engraved or textured in any desired manner without deviating from the scope of the present invention.

Although there has been described and illustrated a modular wristwatch assembly and a modular wristwatch case for case for the same in accordance with the present invention for purposes of illustrating the manner in which the invention may be used to advantage, it is to be appreciated that the invention is not limited thereto. Therefore, any and all variations and modifications that may occur to those skilled in the applicable art are to be considered as being within the scope and spirit of the claims as appended hereto.

What is claimed is:

1. A modular wristwatch assembly, said assembly comprising:

a. a case bezel having a transparent watch crystal mounted therein;

b. first and second pairs of watch band lugs joined to opposite exterior side edge regions of said bezel;

c. a rigid watch back member;

d. a rigid, annular watch movement retaining member disposed between said bezel and said back member;

e. a watch movement having a watch face and time indicating means, said watch movement being installed in said watch movement retaining member and having operating controls extending outwardly through said retaining member and with the watch face and time indicating means visible through the watch crystal in the bezel;

f. a decorative ring detachably attached around an inner peripheral region of said watch movement retaining member above adjacent an upper side edge surface region of the watch face so as not to interfere with the time indicating means while being visible through the watch crystal, said decorative ring being readily removed from said inner peripheral region of the watch movement retaining member so as to be replaceable by a different decorative ring to thereby enable the visual appearance of said wristwatch assembly to be easily varied; and g. means for detachablably attaching said bezel and said watch back member together with said watch movement retaining member, said watch movement and said decorative ring being thereby retained between the bezel and the back member, said attaching means including a plurality of ears sidewardly projecting from side edge regions of said watch back member, said ears being located with mounting apertures aligned with said watch band attachment lugs and including screws installed through the apertures in said ears and extending into threaded recesses in lower regions of said lugs.

2. The modular wristwatch assembly as claimed in claim 1, wherein said decorative ring is detachably attached to said watch face.

3. The modular wristwatch assembly as claimed in claim 1, including a transparent crystal installed in said watch back member so that an underside of said watch movement installed in said watch movement receiving member is visible through said watch back member.

4. A modular wristwatch assembly, said assembly comprising:

a. a case bezel having a transparent watch crystal mounted therein;

b. first and second pairs of watch band lugs joined to opposite exterior side edge regions of said bezel;

c. a rigid watch back member;

d. a rigid, annular watch movement retaining member disposed between said bezel and said back member;

e. a watch movement having a watch face and time indicating means, said watch movement being installed in said watch movement retaining member and having operating controls extending outwardly through said retaining member and with the watch face and time indicating means visible through the watch crystal in the bezel;

f. a decorative ring detachably attached around an inner peripheral region of said watch movement retaining member above adjacent an upper side edge surface region of the watch f ace so as not to interfere with the time indicating means while being visible through the watch crystal, said decorative ring being readily removable from said inner peripheral region of the watch movement retaining member so as to be replaceable by a different decorative ring to thereby enable the visual appearance of said wristwatch assembly to be easily varied; and g. means for detachablably attaching said bezel and said watch back member together with said watch movement retaining member, said watch movement and said decorative ring retained between the bezel and the back member.

5. The modular wristwatch assembly as claimed in claim 4, wherein said attaching means includes a plurality of ears sidewardly projecting from side edge regions of said watch back member, said ears being located with mounting apertures aligned with said watch band attachment lugs and including screws installed through the apertures in said ears and extending into threaded recesses in lower regions of said lugs.

6. The modular wristwatch assembly as claimed in claim 4, wherein said back member includes a transparent region for enabling portions of said watch movement to be viewed.

* * * * *